US007325813B2

(12) United States Patent
Bock

(10) Patent No.: US 7,325,813 B2
(45) Date of Patent: Feb. 5, 2008

(54) SKATE BOOT

(76) Inventor: Samuel Bock, 777 Querbes Ave., Montreal, Quebec (CA) H2V-3W8

( * ) Notice: Subject to any disclaimer, the term of this patent is extended or adjusted under 35 U.S.C. 154(b) by 131 days.

(21) Appl. No.: 10/876,716

(22) Filed: Jun. 28, 2004

(65) Prior Publication Data

US 2005/0229436 A1 Oct. 20, 2005

Related U.S. Application Data

(60) Provisional application No. 60/561,915, filed on Apr. 14, 2004.

(51) Int. Cl.
*A63C 1/02* (2006.01)
*A63C 17/00* (2006.01)

(52) U.S. Cl. ..... 280/11.19; 280/841; 280/11.12; 280/11.221

(58) Field of Classification Search ..... 280/11.19, 280/11.36, 11.221, 11.224–5, 11.201–4, 841, 280/843, 811; 36/88, 89, 115, 114, 68, 69, 36/45, 54–55, 117.1, 117.6
See application file for complete search history.

(56) References Cited

U.S. PATENT DOCUMENTS 2,428,262 A * 9/1947 Bunker ..... 36/51
3,419,974 A * 1/1969 Lange ..... 36/117.6
3,765,108 A * 10/1973 Scott ..... 36/51
4,655,465 A * 4/1987 Schaeffer ..... 280/11.12
4,893,417 A * 1/1990 Dalla Lana ..... 36/10
5,072,529 A 12/1991 Graf
5,498,033 A * 3/1996 Hoshizaki et al. ..... 280/841
6,041,524 A * 3/2000 Brooks ..... 36/93
6,047,975 A * 4/2000 Benoit et al. ..... 280/11.231
6,168,172 B1 * 1/2001 Meibock et al. ..... 280/11.221
6,305,103 B1 * 10/2001 Camargo ..... 36/50.1
6,550,159 B1 4/2003 Madore (Continued)

FOREIGN PATENT DOCUMENTS

CA 1046271 1/1979

(Continued)

OTHER PUBLICATIONS

S. Hancock and al., "The Influence of Three Hockey Skate Boots . . . ", Presented to the International Society of Biomechanics Congress XVII, Calgary, Canada, Aug. 1999.

(Continued)

*Primary Examiner*—J. Allen Shriver
*Assistant Examiner*—Vaughn T. Coolman

(57) ABSTRACT

A skate boot for receiving the foot, the ankle and adjacent leg section of an intended user. The skate boot includes an upper. The upper defines a dorsal upper section and a substantially opposed plantar upper section, a rear upper section extending outwardly from and substantially peripherally to the plantar upper section and an opening allowing the user to insert the foot within the skate boot. The upper includes a deformable region for facilitating the elastic dorsiflexion of the upper between an initial upper configuration and a dorsiflexed upper configuration wherein the dorsal upper section is closer to the rear upper section than in the initial upper configuration, the deformable region being substantially more elastically deformable than adjacent upper portions of the upper and providing an elastic force biasing the upper towards the initial configuration upon dorsiflexion of the upper.

46 Claims, 11 Drawing Sheets

U.S. PATENT DOCUMENTS

| | | | | |
|---|---|---|---|---|
| 6,851,682 | B2 * | 2/2005 | Durocher | 280/11.225 |
| 6,898,876 | B2 * | 5/2005 | Kerrigan | 36/138 |
| 2001/0042324 | A1 * | 11/2001 | Filice | 36/115 |

FOREIGN PATENT DOCUMENTS

| | | |
|---|---|---|
| CA | 1066500 | 11/1979 |
| CA | 1097062 | 3/1981 |
| CA | 1160832 | 1/1984 |
| CA | 1244648 | 11/1988 |
| CA | 2328569 | 10/2001 |
| CA | 2309565 | 11/2001 |
| CA | 2385202 | 10/2003 |

OTHER PUBLICATIONS

T.F. Novacheck, "The Biomechanicsof Running", Gate and Posture, vol. 7, pp. 77-95, Jan. 1998, Journal published by Elsevier.

* cited by examiner

SKATE BOOT

This application claims priority from U.S. Provisional Patent Application Ser. No. 60/561,915 filed Apr. 14, 2004.

FIELD OF THE INVENTION

The present invention relates to skates. More specifically, the present invention is concerned with an improved skate boot.

BACKGROUND OF THE INVENTION

Advanced skaters demand more from a skate boot due to superior skills and maneuverability, the requirement for quick turns and stops, and increased power and strength which increases an ability to flex limbs through a greater range of motion. This requires a skate boot which provides support and a dynamic range of motion.

The biomechanics describing the movement of an unrestrained foot and leg are more dynamic than the limited movements permitted by a traditional skate boots. Currently hockey and inline skates are designed primarily to provide ankle support, using one piece uppers of varying stiffness, with ankle-covering side panels that extend from a skate's achilles tendon guard and the lower boot below. These side panels are usually tightened with lacing in the upper sections of the boot. However, because the lacing eyelets are fixed to the rigidly mounted side panels and tendon guard which are not designed to bend, today's hockey skates are incapable of properly flexing forward or backward when providing full ankle support.

Because the continuous execution of more extreme biomechanical movements exceeds the restricted range of motion provided by traditional skate boot constructions, such skating actions pinch the muscles and tendons in front of the ankle, and chafe the skin and bone of the heel, especially when skate boot laces are tied tightly.

To be effective, skate boot constructions for ice skating or inline roller skating should address the mechanics of skating as well as the anatomical features of the foot, ankle, and lower shin. However traditional skate boot designs have not changed much since they were first invented about 100 years ago. Traditional skate boots utilize a composite one-piece upper which surrounds and supports the ankle, but, in doing so, does not allow for full ankle movement.

Such constructions only allow limited movement, depending on the deflection and flexibility characteristics of the construction materials used. All construction materials have defined yield points that limit how far the material's structure can be strained before it permanently bends, creases, or is distorted in some other manner. Today's more dynamic skating movements exceed the flexibility yield points of rigid skate boot materials, causing a rapid breakdown in the materials making up the side walls of conventional skate boots.

As cited in research on the influence of skate boot design on ankle biomechanics, done by Hancock, Lamontagne, Stothart and Sveistrup at the University of Ottawa, "a decrease in range of motion corresponded to an increase in elastic joint moment and an increase in joint stiffness. If this joint restriction is excessive, a skater will have to adapt with a change in skating technique that may create undue fatigue or a decrease in skating efficiency. These findings suggest that the design and construction of a hockey skate boot has a definite influence on the functioning of the ankle joint complex, and skate manufacturers should consider these factors when designing for optimal skating performance." (Cited from S. Hancock, M. Lamontagne, J. P. Stothart and H. Sveistrup THE INFLUENCE OF THREE HOCKEY SKATE BOOTS ON THE RANGE OF MOTION, ELASTIC MOMENT AND STIFFNESS OF THE HUMAN ANKLE JOINT COMPLEX, Presented to the International Society of Biomechanics Congress XVII, Calgary, Canada, 1999, which is hereby incorporated by reference). Empirical testing of conventional hockey skate boots confirms this hypothesis.

A modern skate boot typically consists of a high boot and sole which are stiff. The sole is connected to the skate blade sheath or inline roller mechanism. The boot is typically tied with laces through eyelets in the front of the boot. There may be from eight to thirteen pairs of matching eyelets mounted on a typical skate boot. Yet many power skaters only lace a portion of these eyelets, normally starting at the bottom and terminating before the top eyelets are laced, or leaving these top eyelets more loosely fastened. This indicates a problem in the design of conventional skate boots.

Because the base of the foot is several inches above the skating surface, strength must be built into the sides of the boot to provide the stability and control required for turning and stopping. However at times the skater requires flexibility in movement of the foot in the four primary directions: down (plantar flexion), up (dorsiflexion), and laterally right or left (inversion/eversion) about the ankle pivot.

Prior art skate boots significantly restrict the dorsiflexion of the foot. Product testing of such prior art's ability to dorsiflex has shown this to be less than fifteen degrees. This is significantly less than a range of motion achieved through dorsiflexion of the foot. For example, ankle dorsiflexion rotation angles measured on test subjects while running reached a maximum of 30 degrees (cited from Novacheck, T. F. M.D., THE BIOMECHANICS OF RUNNING, Gate and Posture, 7, 1998, which is hereby incorporated by reference).

The leg and ankle allow the foot to dorsiflex or plantarflex by contracting and relaxing muscles attached to the lower leg. Dorsiflexion, necessary for forward leaning flexion of the lower leg over the ankle, is achieved by contracting shin muscles on the front of the leg, and relaxing calf muscles on the back of the leg. The relaxing calf muscles allow a lengthening of the distance between the knee and heel. This allows the tibia to lean forward when skating.

The contraction of muscles on the front of the leg and foot causes a shortening of the distance between the top of the instep and the lower shin on the front side of the ankle. This contraction causes a normal expansion, or swelling, of the muscles and tendons in the front of the ankle. Anything that restricts either of these two movements will impede dorsiflexion of the foot.

Therefore a successful skate design must: allow the tibia to lean forward while providing ankle support, and allow for swelling of muscles and tendons in front of the ankle, just above the instep of the foot. Skate designs, such as most prior art skates, that do not allow advanced skaters to achieve such movement cause irritation and sometimes permanent injury to the skater.

The most serious of these injuries involves the development of heel spurs after intensive use of a restrictive skate boot. At the middle of the skating push phase the foot and skate are in a fully dorsiflexed position. In a conventional skate boot the laces stretch slightly. However, the upper lacing on traditional skate boots is attached to a rigid tendon guard which does not allow it, or the attached lacing, to stretch and travel with a leg that it leaning forward as a dorsiflexion of the foot is performed. The rigidly fixed top row of eyelets of a traditional lacing system ultimately becomes a lifting fulcrum in front of the lower shin once it is initially flexed forward.

If the skater continues to flex forward, the upper portion of the shin, which is now leaned over and against this lacing barrier, forces the lower shin and heel to rotate about the fulcrum caused by the rigid lacing system. The resulting action, a rotation about this fulcrum, causes the heel at the bottom end of the lever to lift upwards and backwards, jamming the heel against the heel support in the skate boot, in turn causing blistering to the heel in the short term. Because the skin and fatty padding beneath the skin of the heel (and achilles tendon) are stretched to their limit at full dorsiflexion, protection from chaffing and shock are reduced, enhancing the potential for large heel spurs over the longer term.

A second cause of irritation on the front of the ankle region, called "lace-bite", is also due to resistance to forward flexion of the leg over the front of the skate's upper lacing system at more extreme angles of dorsiflexion, again during mid stride of the push phase of skating.

"Lace-bite" on the front of the ankle, specifically on the extrinsic extensor hallucis longus muscle and tendon, is caused by skating with tightened upper laces and eyelets that are attached to a rigid tendon guard. This extensor, located on the center to inside front of the foot, connects the large toe bones to the leg.

As described above, when tensed in dorsiflexion, despite being restricted by facial ligaments (superior extensor retinaculum and inferior extensor retinaculum) this tendon's surface profile rises ¼-½ inch above the relaxed surface profile of the front of the foot in a neutral position. The extensor digitorum longus muscle and tendon is on the outside front of the foot and connects to the smaller toes. It also lifts and expands a smaller amount in dorsiflexion. This natural swelling of the ankle further increases pressure against the rigidly mounted lacing system, which is already causing pressure from resisting the action of the forward leaning shin.

Prior art over the years has provided for a number of methods in an attempt to solve the problems described above. However none of these methods provide full ankle flexion in combination with rigid lateral ankle support that is required for aggressive play. This has either caused the patented design to fail entirely in real world testing, or has produced skate boots with limited movement resulting in unnecessary pressure and friction on various parts of the foot and leg when skating powerfully.

In U.S. Pat. No. 6,550,159 issued to Madore on Apr. 22, 2003 and in Canadian Patent Application No. 2,309,565 filed in the name of Madore and published on Nov. 25, 2001, which are hereby incorporated by reference, a skate boot which comprising an articulated cuff for encircling and supporting the ankle of a skater is described. The articulated cuff is partially inserted in the foot element and slidably coupled to the foot element to permit unrestrained limited pivotal motion of the articulated cuff relative to an axis coinciding approximately with the pivot axis of the skater's ankle.

However the design of this skate is problematic for several reasons. First the ankle's axis of rotation relative to the foot is a few inches above the resting plane of the foot itself. As with any such axis point, any radial member attached above the axis will rotate in one direction, and anything below will rotate in the opposite direction. This means that as the cuff positioned above the ankle's rotation axis is rotated forward (with the shin that is flexing forward), any structural attachment extending below this point (to be anchored to the foot below) will rotate backwards at the same time. This backward motion must be shielded from the foot itself which is not moving, otherwise it will chafe the foot. This would require a "slidable track" described in the patent to be buried in the side of the boot under a stationary piece of material which would rest against the foot. The track would also increase the width of the heel, and weight of the boot. In addition, such a track would describe an arc proportional to the distance of the track from the fixed position of the ankle's axis of rotation. This is problematic as it requires a fixing of the athlete's ankle position, and this ankle position is different in every athlete.

More problematic, the range of motion required for skating is limited by the design presented in these documents. The slidable track beneath the ankle is positioned forward to allow full plantar flexion. However this positioning leaves little room for backward movement of the cuffs track, necessary for forward flexion of the cuff under dorsiflexion. Furthermore, where as a traditional tendon guard is one continuous piece, this design requires a split boot, which when leaned forward will cause the tendon guard to gap open, creating the potential to get full of snow and wet. Obstructing matter could also get jammed in the opening as well, preventing the boot from returning to its closed upright position.

Madore and Wright's subsequent Canadian Patent Application No. 2,328,569 published on Oct. 28, 2001, which is hereby incorporated by reference, attempts to solve these problems by substituting the rigid side and tendon panels of a conventional skate, which eventually breakdown, with flexible molded side panels.

However successful hockey skates require rigid sidewalls to provide adequate ankle support required for aggressive play associated with hockey. Madore and Wright's foam side panels allow greater potential for dorsiflexion and plantar flexion than most conventional skates, but are very soft and do not provide rigid lateral support required by aggressive professional players.

Felice, in Canadian Patent Application No. 2,385,202, published Oct. 5, 2003, which is hereby incorporated by reference, describes the use of a flexible ankle encircling cuff made of synthetic moldable plastic material capable of flexing in the forward, aft, and lateral directions to act as an energy storage and release device and without wrinkling so as to minimize discomfort and abrasion on the user's ankle and extend the useful life of the boot. The tongue portion of the boot has a similar molded synthetic flexible panel separating the upper and lower sections of the tongue.

This skate only achieves dorsiflexion by collapsing and bunching in the front, rather than elongating and stretching in the rear as one's achilles tendon is designed. A bunching elastomer included in the design displaces increased volume at front of the ankle when collapsing to accommodate forward lean associated with dorsiflexion. This design further compounds crowding problems caused by tissue expansion on the front of the foot when in a dorsiflexed position. It also causes increased heal lift under dorsiflexion and does not improve a range of motion of the skate during plantar flexion.

Felice's flexible/collapsible "Stove pipe" tube, while different from Madore and Wright's skate describe in Canadian Pat. No. 2,328,569, still does not have any rigid lateral ankle support, and is capable of collapsing in any direction, not providing the lateral ankle stability required for hockey.

Successful hockey skates require rigid sidewall support to provide adequate ankle support for aggressive play associated with hockey.

Schaeffer, in Canadian Patent 1,244,648, issued Nov. 15, 1988, and which is hereby incorporated by reference, describes a skate boot that allows very limited bending of a tendon guard, but not in amounts sufficient, and without the elongation required of power skaters generating more than 15 degrees of dorsiflexion.

The design also has the same flaw that causes all traditional skates to loose ankle support with age, as the side panels are not designed to deform and deflect under forward or backward flexion. While both the tendon guard on the back of this skate boot and the notched lacing systems on the front of this skate boot allow limited potential for forward flexion, the rigid one piece side panels connecting the latter and former do not. The only way such designs can flex forward or aft is if the side panel bends, which eventually causes a breakdown in skate boot support. This is the primary reason why skates wear out so quickly at the professional level.

U.S. Pat. No. 5,072,529 issued to Karl Graf on Dec. 17, 1991, and which is hereby incorporated by reference, describes a pivotable leg flap covering each ankle of a skate which moves with the ankle. The leg flap moving only in a laterally extended plane, not longitudinal, allowing increased lateral ability, but no additional forward motion of the tibia. The leg flap is provided with a second lacing region, which cooperates with a lower lacing region. This is to prevent the problem of the pad rubbing on the ankle and, because of the high surface pressure present, which often gives rise to irritation or even inflammation of the ankle section on the foot.

This skate doesn't solve the problems of irritation on the extensor hallucis longus, or the lack of flexibility in the tendon guard, which prevents the leg flap from fully pivoting as it should. The upper lacing attached to this flap causes heal lift under dorsiflexion as with all traditional skate designs. It also does nothing to improve plantar flexion, prevent tongue slip, or address the asymmetrical positions of the anklebones.

Linner and Linner in Canadian Pat. No. 2,212,229 published Aug. 15, 1996, and which is hereby incorporated by reference, teach of a complicated device in which a skate boot, shin pad, and other armored parts about the ankle are connected together, but that only move in one directional plane and don't allow any lateral rotation of the shin relative to the ankle. Eliminating the ability to laterally rotate the ankle, which is required by this design, would make advanced skating impossible. Moreover the design makes it impossible to secure the upper ankle properly. It's also too heavy and has many elastically loaded moving armor parts which are subject to lifting and jamming while in play.

The prior art of Olivieri in Canadian Patent No. 1,160,832, issued Jan. 24, 1984, Caporicci in Canadian Patent No. 1,066,500, issued Nov. 20, 1979, Mikhail in Canadian Patent No. 1,097,062, issued Mar. 10, 1981, and Bourque in Canadian Patent No. 1,046,271, issued Jan. 16, 1979, which are all hereby incorporated by reference, all teach of skates including various molded plastic skate boots with interior liners.

Several of the designs achieve full ankle mobility with different hinging ankle cuffs. However the hard plastic constructions required separate interior bladders or liners which deprive the skater of the fit and feel required for advanced performance. Such bladders are separate units which are slipped into the exterior plastic shell.

However, because they are designed as separate units, they are prone to slipping inside the shell. Such designs are adapted to skate design from the ski industry, where separate interior bladders do not affect a skier's performance as they affect a skater's. All such designs were subsequently passed over by professional players who achieved better performance in tightly fitting one-piece composite constructions of leather and synthetic leather lace-up constructions which are capable of custom forming to the foot of the individual athlete. No prior art has been able to achieve increased ankle mobility without a separate removable bladder. The skates described in these four patents also lack the additional lateral ankle support required by top hockey players.

None of the prior art cited hereinabove provides for a skate boot which is effective for the low hip, high dorsiflexion, power skating position of advanced skaters. The prior art either lacks flexibility, rigid lateral support, is too stiff, is too heavy, requires a separate bladder, is ineffective, or is too expensive to manufacture.

Against this background, there exists a need in the industry to provide a novel improved skate boot.

OBJECTS OF THE INVENTION

An object of the present invention is therefore to provide an improved skate boot.

SUMMARY OF THE INVENTION

More specifically, in accordance with the present invention, there is provided a skate boot for receiving the foot, the ankle and adjacent leg section of an intended user. The foot defines a dorsal foot section and a substantially opposed plantar foot section. The skate boot includes an upper. The upper defines a dorsal upper section and a substantially opposed plantar upper section, a rear upper section extending outwardly from and substantially peripherally to the plantar upper section and an opening allowing the user to insert the foot within the skate boot. The opening extends between the rear upper section and the dorsal upper section. The upper includes a deformable region for facilitating the elastic dorsiflexion of the upper between an initial upper configuration and a dorsiflexed upper configuration wherein the dorsal upper section is closer to the rear upper section than in the initial upper configuration, the deformable region being substantially more elastically deformable than adjacent upper portions of the upper and providing an elastic force biasing the upper towards the initial configuration upon dorsiflexion of the upper.

Advantageously, the skate boot allows the foot of the user to properly dorsiflex while providing a suitable ankle support. This is achieved through a structure that allows the skate to perform its function without excessive deterioration. In addition, risks of injuries to the user during use of the skate are greatly reduced in comparison with most prior art skates.

In some embodiments of the invention, the deformable region is provided at least in part within the rear upper section. Also, in some embodiments of the invention, the deformable region is provided at least in part within a lateral upper section of the boot.

In a variant, the skate boot includes a heel counter including a hollow for receiving the ankle of the foot and a deformable padding provided in proximity to the hollow. The deformable padding and the hollow cooperate to distribute a force exerted by the upper onto the heel of the user over an area that is larger than an area over which the force exerted by the upper onto the heel is distributed when the hollow is absent from the upper, thereby reducing the pressure exerted onto the heel.

In another variant, the skate boot includes a slit provided within the rear upper section, the slit being covered by a deformable material. The slit improves the capacity of the foot of the user to perform a plantar flexion.

In another variant, the skate boot includes an anatomically shaped tongue. In addition, the tongue includes a rigid material to protect the foot of the user from lace bite.

In addition to weight savings, and increased durability, flexibility, and comfort provided by the skate boot, muscular forces generated by the skater are better transmitted from the skate boot to the ice surface in the claimed skate boot. By experimentation it has been discovered that this design allows the skater to achieve lower, more powerful and efficient skating positions with full ankle support.

Other objects, advantages and features of the present invention will become more apparent upon reading of the following non-restrictive description of preferred embodiments thereof, given by way of example only with reference to the accompanying drawings.

DETAILED DESCRIPTION

Figure 1A:
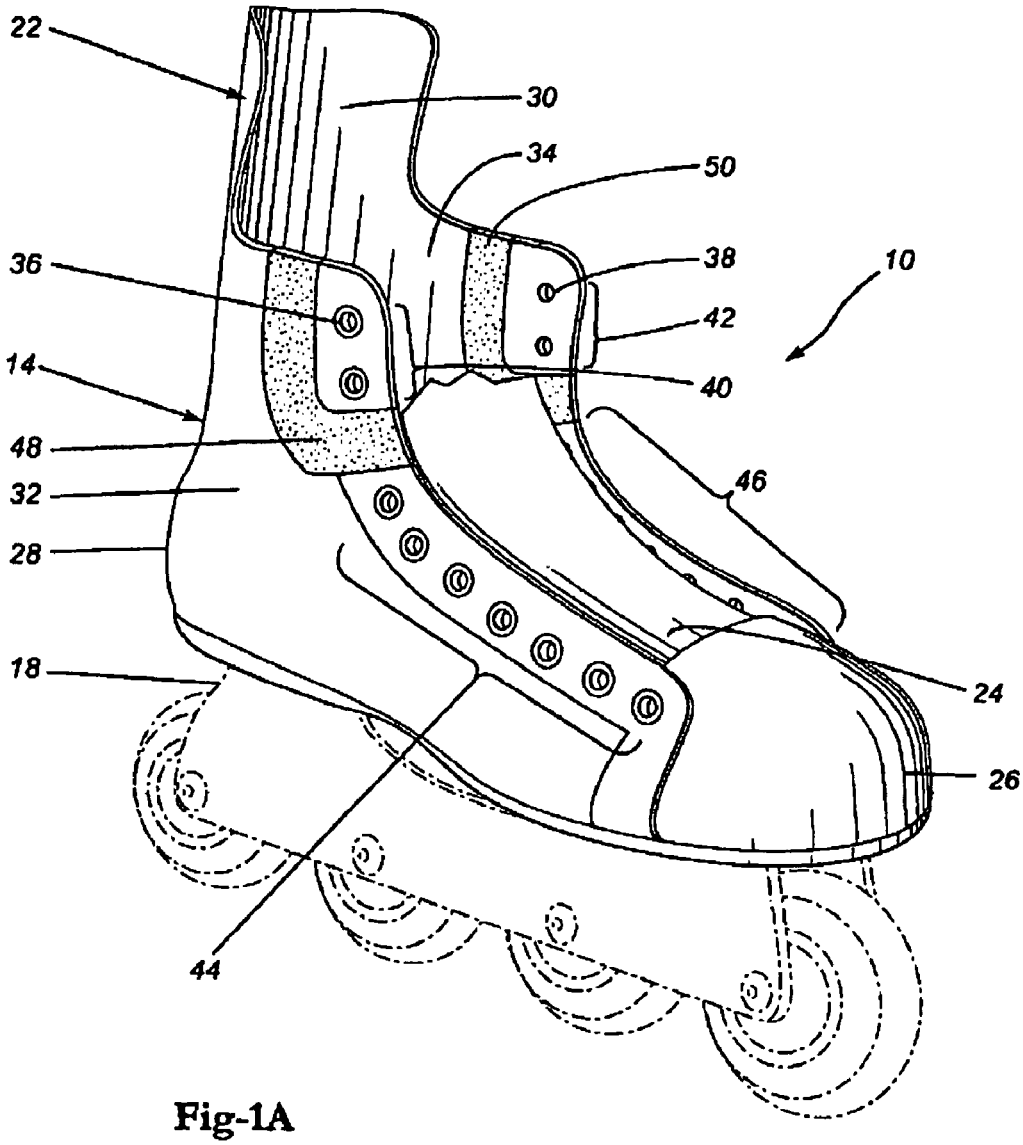
FIG. 1A is a perspective view of a skate including a skate boot including a deformable region.
Figure 1B:
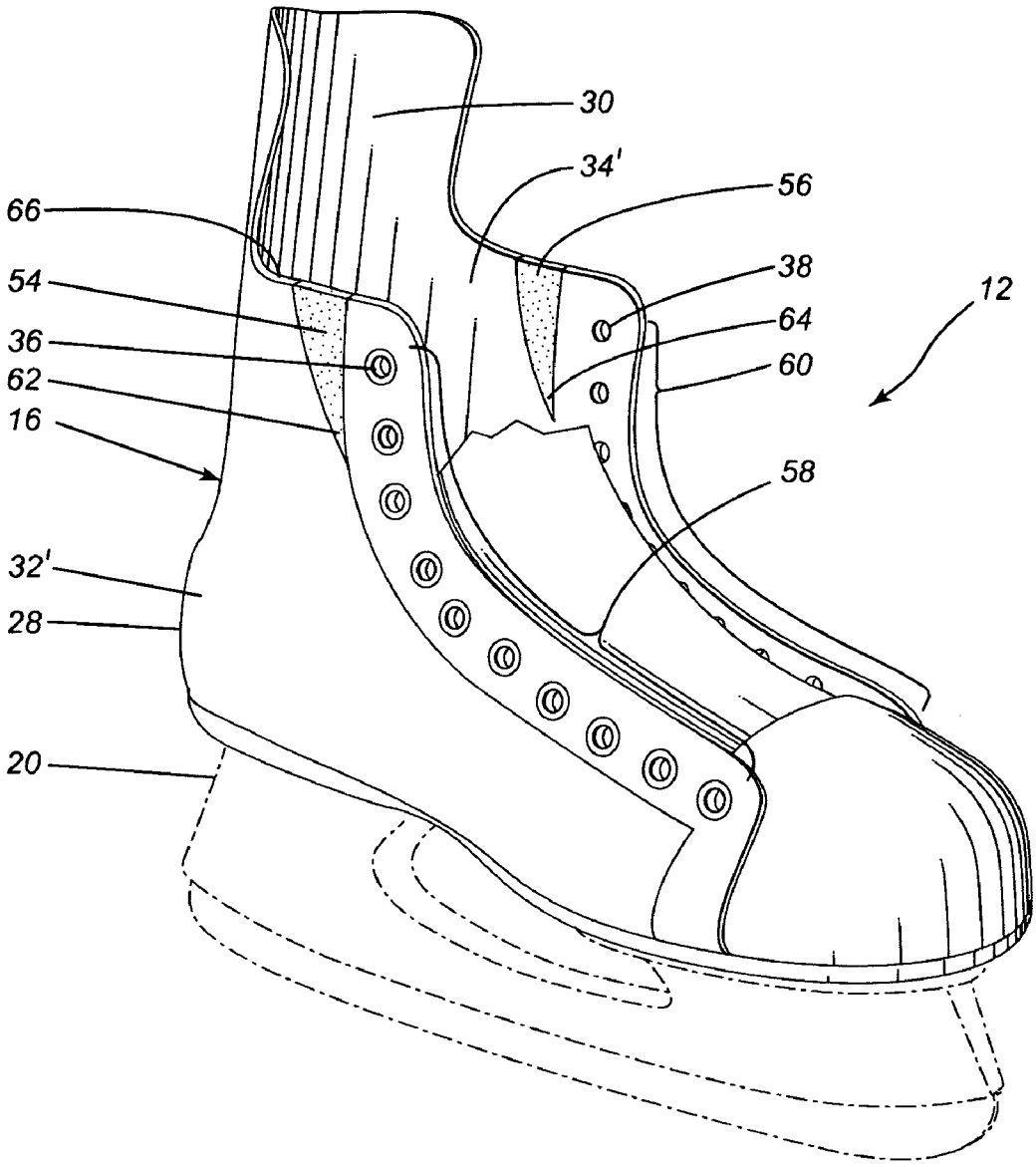
FIG. 1B is a perspective view of an alternative skate including an alternative skate boot including a deformable region.

FIGS. 1A and 1B show, respectively, a roller skate 10 and an ice skate 12. Each of the skates 10 and 12 includes a respective skate boot 14 and 16. The skate boots 14 and 16 are for receiving the foot, the ankle and adjacent leg section of an intended user (not shown in the drawings). The foot defines a dorsal foot section and a substantially opposed plantar foot section.

The ice skate 10 includes a roller assembly 18 connected to the boot 14. Similarly, the ice skate 12 includes a blade assembly 20 connected to the boot 16. Such roller and blade assemblies being well known in the art, they will therefore not be described in further detail therein.

In addition, even if some embodiments of the present invention are shown in the drawings within a skate including either a roller assembly or a blade assembly, the reader skilled in the art will readily appreciate that in all embodiments of the invention any suitable roller or blade assembly can be used without departing from the scope of the invention.

The skate boot 14 includes an upper 22. The upper 22 defines a dorsal upper section 24 and a substantially opposed plantar upper section 26. In addition, the upper 22 defines a rear upper section 28 extending outwardly from and substantially peripherally to the plantar upper section 26. An opening 30 allows the user to insert the foot within the skate boot 14. The opening 30 extends between the rear upper section 28 and the dorsal upper section 24.

The upper 22 further defines first and second lateral upper sections 32 and 34, each extending substantially outwardly from and substantially peripherally to the plantar upper section 26. The rear upper section 28 connects the first and second lateral upper sections 32 and 34.

The dorsal upper section 24 is in proximity to the dorsal foot section when the foot is inserted within the boot. Similarly, the plantar upper section 26 is in proximity to the plantar foot section when the foot is within the boot 14.

The upper 22 includes a deformable region for facilitating the elastic dorsiflexion of the upper 14 between an initial upper configuration and a dorsiflexed upper configuration wherein the dorsal upper section 24 is closer to the rear upper section 28 than in the initial upper configuration. The deformable region is substantially more elastically deformable than adjacent upper portions of the upper 22 and provides an elastic force biasing the upper 22 towards the initial configuration upon dorsiflexion of the upper 22.

The deformable region reduces a buckling of the lateral upper sections 32 and 34 upon a dorsiflexion of the upper 22 wherein the upper 22 passes from the initial upper configuration to the dorsiflexed upper configuration.

Although not required in some embodiments of the invention, the boot 14 includes a fastening device for connecting the first and second lateral upper sections 32 and 34. In boot 14, the fastening device includes two eyelets 36 and 38. The eyelet 36 is provided within the first lateral upper section 32, while the second eyelet 38 is provided within the second lateral upper section 34. In typical use, although not shown in the drawings, a lace connects the eyelets 36 and 38.

The reader skilled in the art will readily appreciate that in other embodiments of the invention, alternative suitable fastening devices are used. Non-limitative examples of such devices include buckles and clips, among others.

Although not required in some embodiments of the invention, the boot 14 includes a plurality of eyelets for receiving a lace (not shown in the drawings), including the eyelets 36 and 38. More specifically, the boot 14 includes a first strip of eyelets 40 and a second strip of eyelets 42. The first strip of eyelets 40 includes the eyelet 36, while the second strip of eyelets 42 includes the second eyelet 38. Furthermore, the boot 14 includes a third and a fourth strip of eyelets 44 and 46. The first and second strips of eyelets are separated respectively from the third and fourth strip of eyelet 44 and 46 by the deformable region in the embodiment of the invention shown in FIG. 1A.

Upon a dorsiflexion of the foot, the boot allows a mobile fastening portion including within the fastening device to be further from at least part of the rear upper when the upper is in the dorsiflexed upper configuration than when the upper is in the initial configuration. More specifically, upon a dorsiflexion of the foot, the boot 14 allows the mobile fastening portion in the form of the eyelets 36 and 38 to be further from at least part of the rear upper section 28 when the upper 22 is in the dorsiflexed upper configuration than when the upper 22 is in the initial upper configuration. In other words, the eyelets 36 and 38 are moved away from at least part of the rear upper section 28 by the foot and leg of the user upon a dorsiflexion of the foot. This movement of the eyelets 36 and 38 with respect to the rear upper section 28 is not typically allowed in commonly available skates. This movement is more anatomically correct than the movement that can be achieved in many prior art skates. In addition, in the boot 14, the first strip of eyelets 40 and the second strip of eyelets 42 are also within the mobile fastening portion.

The boot 14 includes two deformable regions 48 and 50 which are substantially L-shaped. The deformable regions 48 and 50 are respectively provided within the lateral upper sections 32 and 34 and elastically mount respectively the first and second strips of eyelets 40 and 42, and consequently the eyelets 36 and 38, to the rest of the boot 14.

Therefore, the deformable regions 48 and 50 allow the eyelets 36 and 38 to be moved with respect to the rear upper section 28 and the plantar upper section 26 independently from adjacent portions of the boot 14.

The boot 14 is manufactured using any suitable material such as, for example, leather, synthetic leather and polymers, among others. The exact material used in the fabrication of the boot 14 is not critical to the present invention.

In addition, the deformable regions 48 and 50 include any suitable material substantially more deformable than the material of adjacent portions of the boot 14. Non-limiting examples of such a suitable materials include rubber, polyurethane, vulcanized rubber, Lycra™ and other synthetic polymers, among others.

In some embodiments of the invention, the deformable regions 48 and 50 each include a panel blocking a cut-out region of the upper 24. In this case, and in other embodiments of the invention, the deformable regions 48 and 50 are attached to adjacent portions of the boot through any suitable method such as, for example, through gluing or stitching, among others.

Turning to FIG. 1B, there is shown the boot 16 which is an alternative embodiment of the boot 14. The boot 16 is similar to the boot 14, except that the L-shaped deformable regions 48 and 50 are not present within the boot 16. Instead, deformable regions 54 and 56 are provided respectively within lateral upper sections 32' and 34' of the boot 16. The lateral upper sections 32' and 34' are similar to the lateral upper section 32 and 34.

Another difference between the boot 14 and the boot 16 resides in the eyelets. Indeed, the boot 16 includes two strips of eyelets 58 and 60, instead of four strips of eyelets in boot 14. The function of the strips of eyelets 58 and 60 is similar to the function of the strip of eyelets 40, 42, 44 and 46.

The deformable regions 54 and 56 each include a substantially tapered portion tapered towards the plantar upper section 26. More specifically, the deformable regions 54 and 56 each include a respective point 62 and 64. In the specific embodiment shown in FIG. 1B, the opening 30 defines a peripheral opening edge 66. The deformable regions 54 and 56 extend to the peripheral opening edge 66.

Similarly to deformable regions 48 and 50, deformable regions 54 and 56 allow eyelets 36 and 38 to be mobile with respect to the rear upper section 28, thereby improving the ergonomics of the skate 12.

Figure 1C:
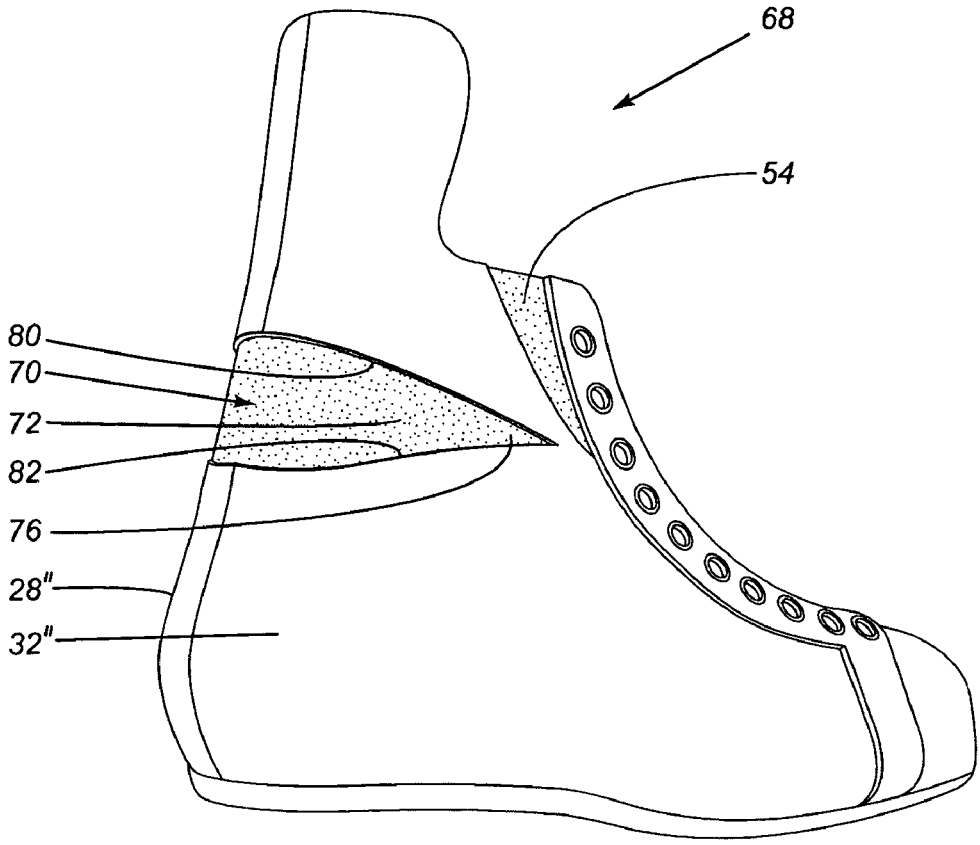
FIG. 1C is a perspective view of another alternative skate boot including a deformable region.
Figure 1D:
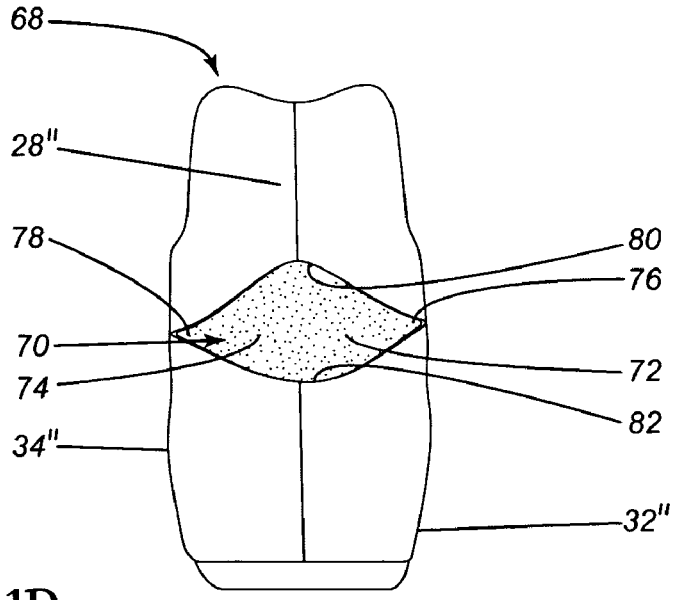
FIG. 1D is a rear elevation view of the skate boot of FIG. 1C.

FIGS. 1C and 1D show an alternative boot 68 usable for an ice skate or a roller skate. The boot 68 is similar to the boot 16, except for the addition within the boot 68 of a further deformable region 70. The deformable region 70 is provided in part, within a rear upper section 28' similar to the rear upper section 28.

In addition, the deformable region 70 is further provided in part, within a first lateral upper section 32" and a second lateral upper section 34". The deformable region 70 includes a first and second tapered extremities provided respectively within the lateral upper sections 32" and 34". The tapered extremities 72 and 74 point substantially away from the rear upper section 28'.

Although not essential in some embodiments of the inventions, the tapered extremities 72 and 74 respectively define first and second apexes 76 and 78. Therefore, the deformable region 70 defines first and second peripheral deformable region edges 80 and 82 merging at the first and second apexes 76 and 78.

In some embodiments of the invention, as shown in FIGS. 1C and 1D, the deformable region 70 is shaped such that the first and second peripheral deformable region edges 80 and 82 are maximally distanced at a location substantially midway between the first and second apexes 76 and 78.

The reader skilled in the art will readily appreciate that in some embodiments of the invention, the deformable regions 54 and 56 are not necessarily provided within the boot 68. Therefore, in these embodiments, only the deformable region 70 is deformable to allow the eyelets 36 and 38 to be mobile with respect to the upper rear section 28".

Figure 2A:
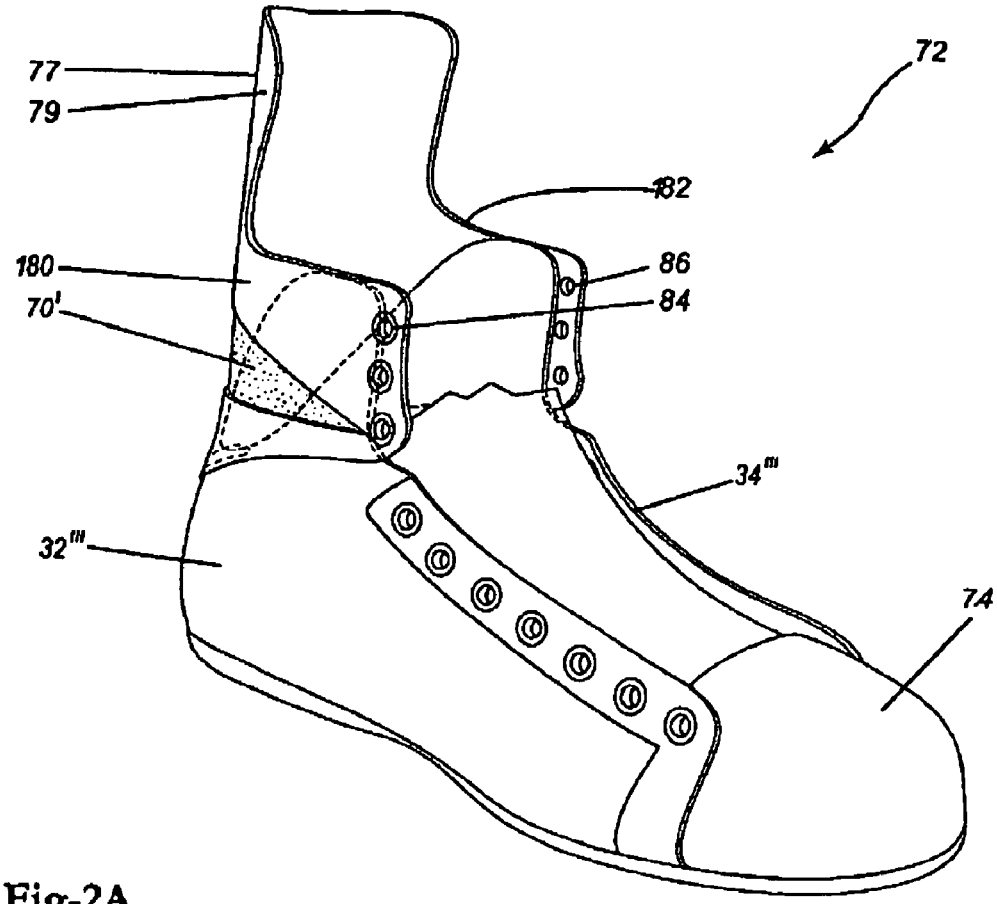
FIG. 2A is a perspective view of yet another alternative skate boot including a deformable region.

FIGS. 2A, 2B, 2C, 2D, 2E, 2F, 2G, 2H, 2I and 2J illustrate a different type of skate boot. Referring to FIG. 2A, there is shown a skate boot 72 including a first segment 74 and a second segment 77. The first and second segments 74 and 77 are attached together.

The first segment 74 is similar to the boot 14 from which the deformable portions 48 and 50, some eyelets, and part of the rear upper section 28 has been removed. Equivalents to these removed parts are found on the second segment 77.

Specifically, the second segment 77 defines rear segment section 79 and two lateral flaps 180 and 182. The two lateral flaps 180 and 182 are each connected to the rear segment section 79 and extend on an exterior surface of the lateral upper sections 32''' and 34''' of the boot 72. In addition, strips of eyelets 84 and 86 are provided within the flaps 180 and 182.

Figure 2B:
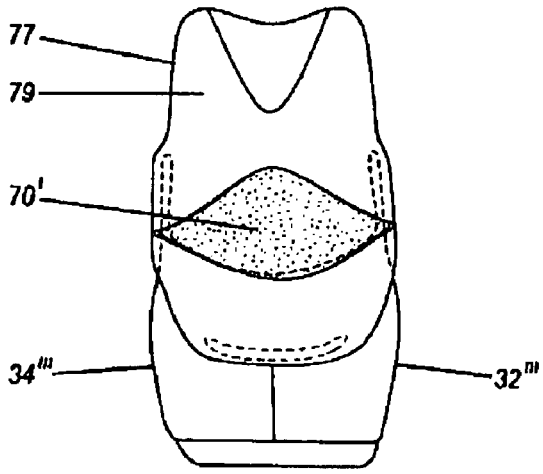
FIG. 2B is a rear elevation view of the skate boot of FIG. 2A.

As better shown in FIG. 2B, the second segment 77 includes a deformable region 70' which is similarly shaped and performs functions similar to the deformable portion 70.

Also, as shown in FIG. 2B, the first and second segments are attached together at the rear upper section 28''' of the boot 72. The reader skilled in the art will readily appreciate that the first and second segments 74 and 76 are attached through any suitable method including stitching and gluing, among others. Therefore, the flaps 180 and 182, and consequently the strips of eyelets 84 and 86, are free to move with respect to the first segment 74.

Figure 2C:
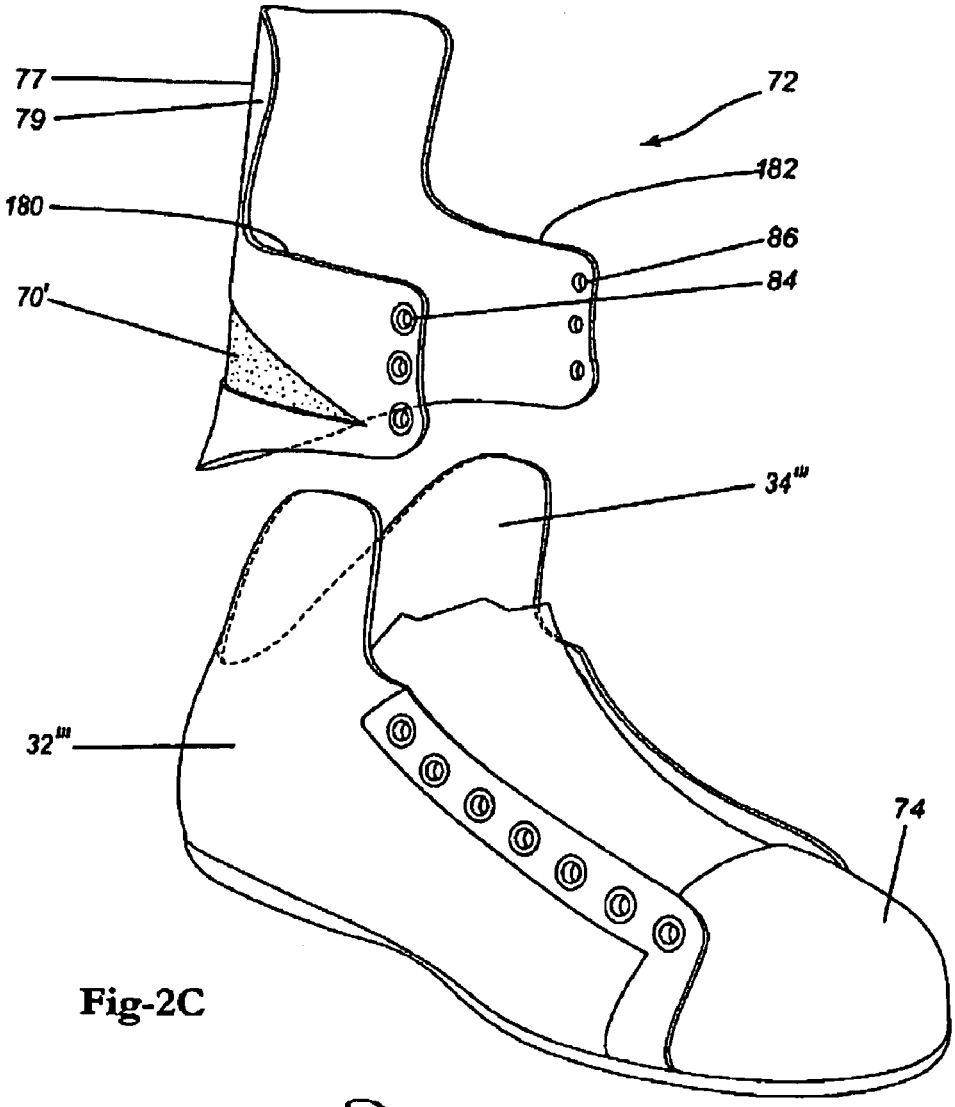
FIG. 2C is an exploded view of the skate boot of FIG. 2A.
Figure 2D:
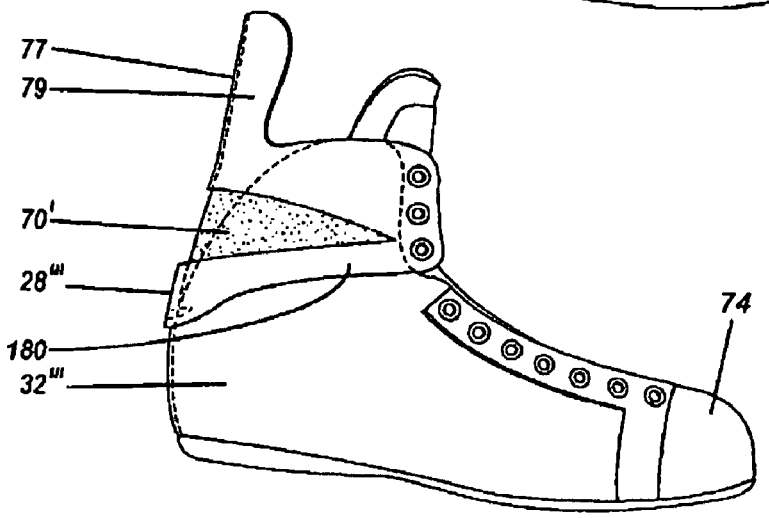
FIG. 2D is a side elevation view of the skate boot of FIG. 2A.

FIGS. 2C and 2D illustrate the boot 72 and more specifically, FIG. 2C illustrates the first and second segments 74 and 76 detached from each other, and FIG. 2D illustrates the relationship of the flap 80 with respect to the lateral upper section 32'''.

Figure 2E:
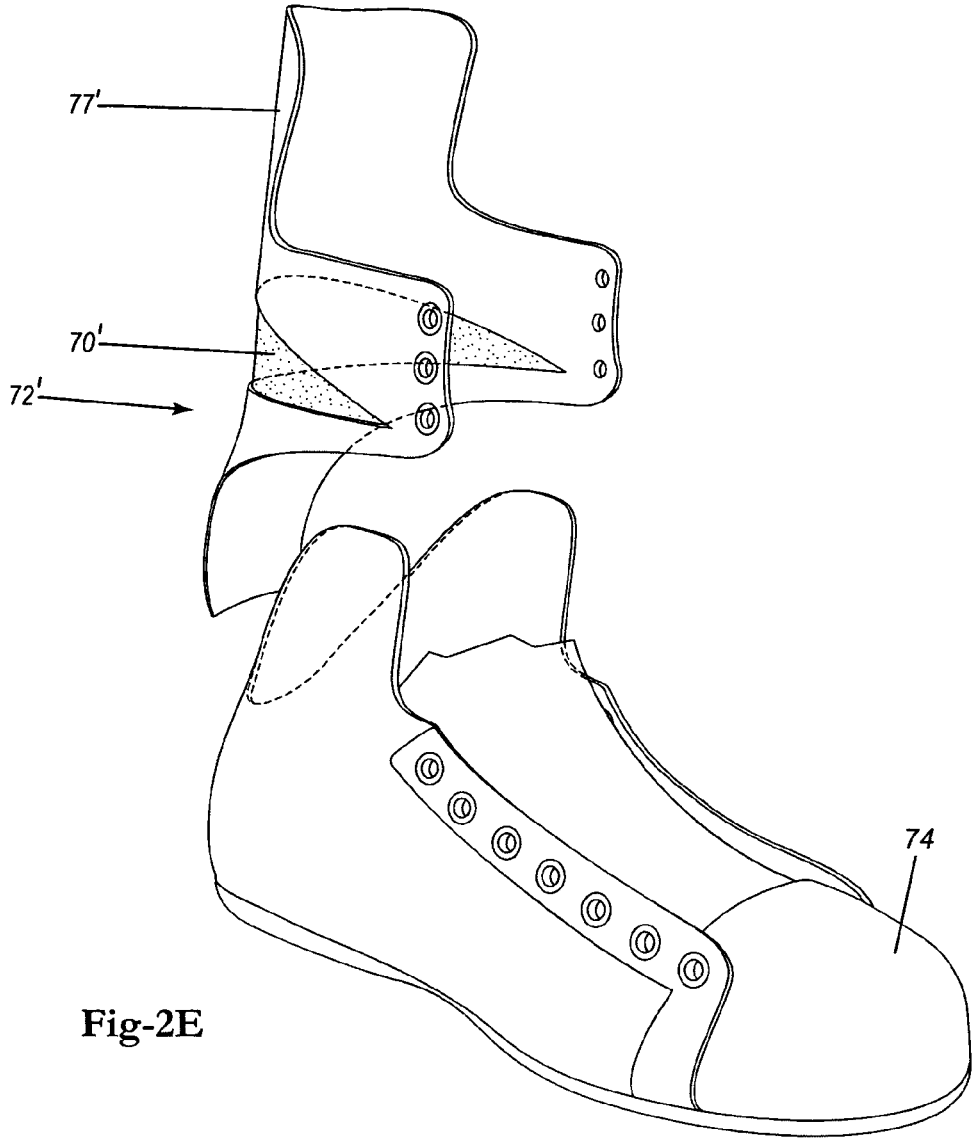
FIG. 2E is an exploded view of yet another alternative skate boot including a deformable region.
Figure 2F:
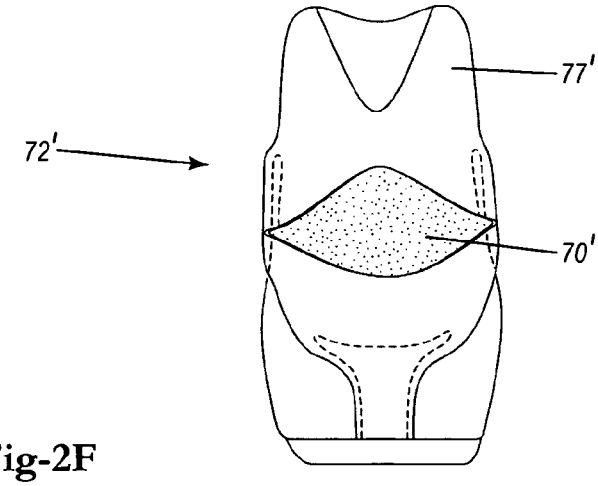
FIG. 2F is a rear elevation view of the boot of FIG. 2E.
Figure 2G:
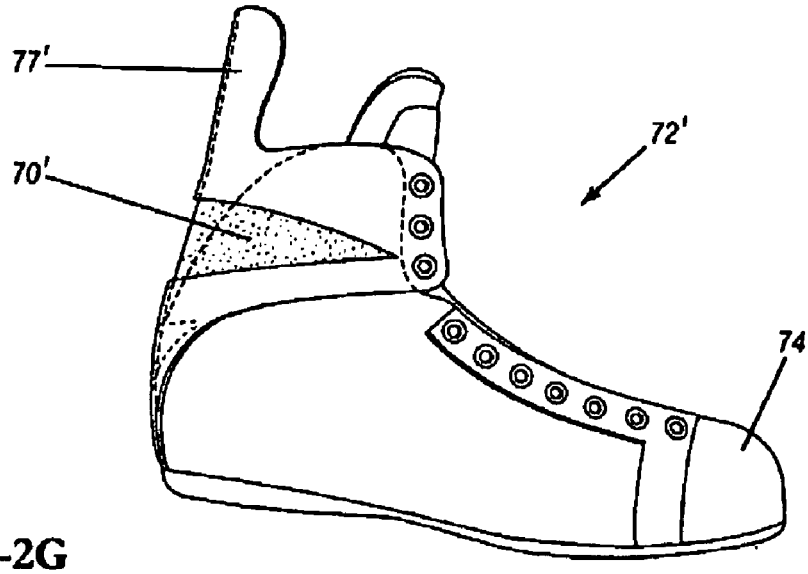
FIG. 2G is a side elevation view of the skate boot of FIG. 2E.

FIGS. 2E, 2F and 2G illustrate an alternative boot 72' similar to the boot 72. A difference between the boot 72' and the boot 72 resides in the way into which a first segment 74 of the boot 72' attaches to a second segment 77' of the boot 72'.

The second segment 77' is shaped differently than the second segment 77. More specifically, the second segment 77' extends more towards the plantar upper section of the boot 72. This allows attachment of the second segment 77' to the first segment 74 more solidly than in boot 72.

Figure 2H:
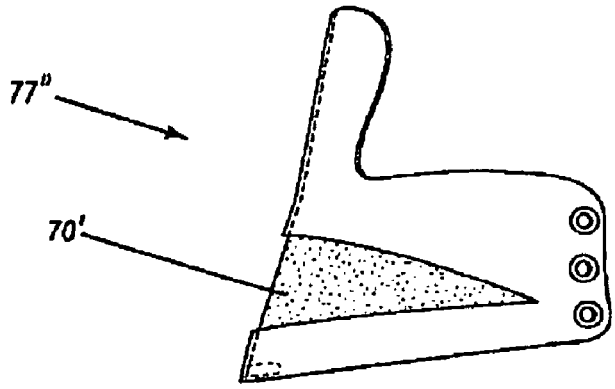
FIG. 2H is a side elevation view of a segment of yet another alternative skate boot.

FIG. 2H illustrates yet another second segment 77" which is similar to the second segment 77, except that the second segment 77" extends less towards the plantar upper surface of the boot to which it is attached.

Figure 2I:
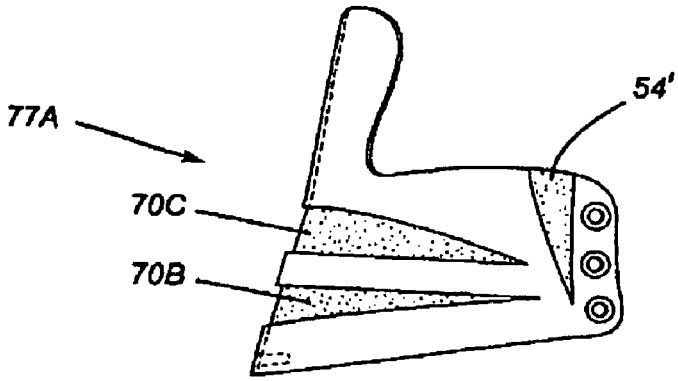
FIG. 2I is a side elevation view of a segment of yet another alternative skate boot.

FIG. 2I illustrates yet another embodiment of a second segment 77A similar to the second segment 77". However, the second segment 77A includes two deformable regions 70B and 70C provided similarly within the second segment 77A to the way through which the deformable region 70' is provided within the second segment 77. In addition, the second segment 77A includes another deformable region 54' similar in function, shape and location to deformable region 54. Although not shown in the drawings, the second segment 77A includes yet another deformable region similar in location, form and function to the deformable region 56.

Figure 2J:
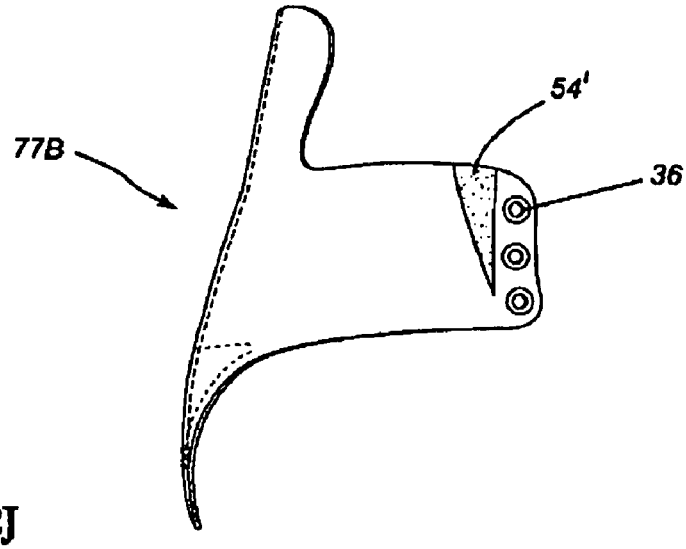
FIG. 2J is a side elevation view of a segment of yet another alternative skate boot.

FIG. 2J illustrates yet another second segment 77B similar to the second segment 77' except that the deformable region 70' is replaced by a deformable region 54' and another similar deformable region not shown in the drawings which are located, configured and sized similarly to the deformable regions 54 and 56.

Figure 3A:
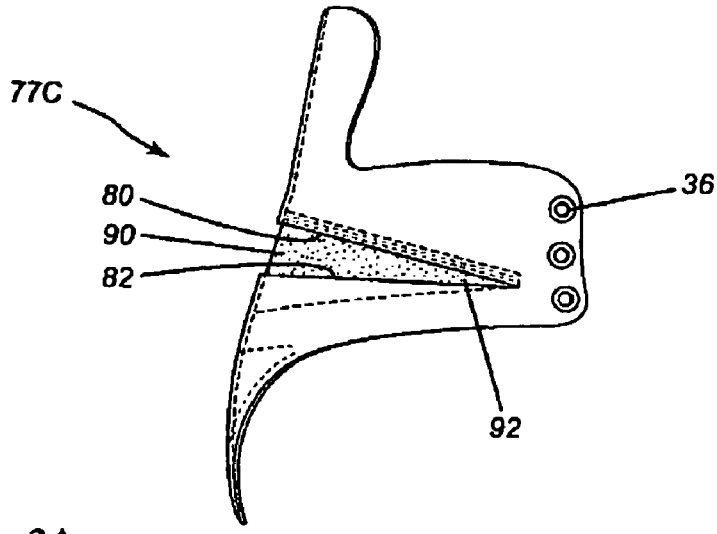
FIG. 3A is a side elevation view of a segment of yet another alternative skate boot.

FIG. 3A shows a second segment 77C similar to the second segment 77'. A difference between the second segment 77C and the second segment 77' resides in that the deformable region 70' is absent from the second segment 77C. Instead, the second segment 77C is provided with a cut-out portion 90 including peripheral edges 80 and 82. The cut-out portion 90 is shaped similarly to the deformable region 70'.

A flap 92 is provided within the second segment 77C and covers the cut-out portion 90. The flap 92 is attached through sewing, gluing or any other suitable method to the second segment 77C in proximity to the edge 80. However, the flap 92 is not attached to the peripheral edge 82.

Figure 3B:
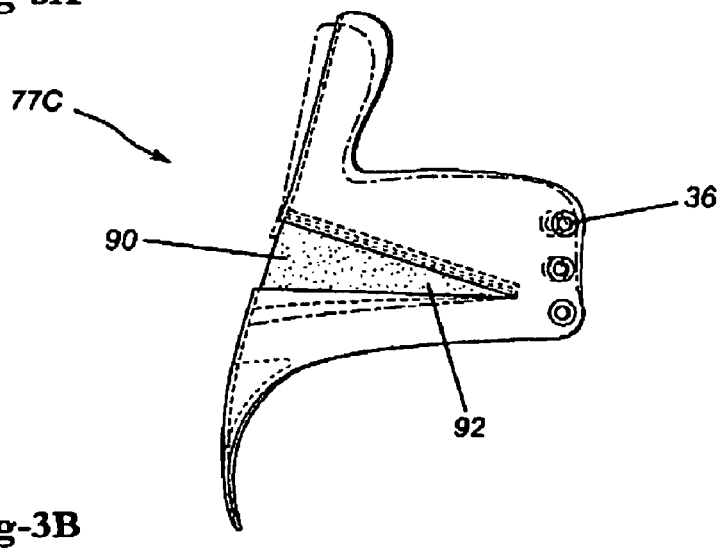
FIG. 3B illustrates the deformation of the segment of FIG. 3A upon dorsiflexion of the foot of an intended user.

Therefore, as shown in FIG. 3B, upon a dorsiflexion of the foot the second segment 77C will deform such that a part of the second segment 77C distal from the plantar upper section is mobile with respect to a part of the second segment 77C proximal to the plantar upper section and attached to the first segment 74. This allows eyelets 36 and 38 to be mobile with respect to the rest of the skate.

In some embodiments of the invention, the flap 92 is configured and sized such that even when a maximal dorsiflexion expected to be performed by the user is performed, the flap 92 still covers in totality the cut-out portion 90, such as to protect the user against the intrusion of any object within the skate to which the second segment 77C.

The reader skilled in the art will readily appreciate that in view of the examples provided hereinabove the deformable region can take many suitable shapes. In addition, the upper within which the deformable region is provided can be manufactured from any number of segments. Also, the exact number of deformable regions provided within the upper is not critical to the present invention and instead will depend on the shapes and locations of the deformable regions, as well as on expected forces to be exerted upon the deformable regions by the user.

Figure 6A:
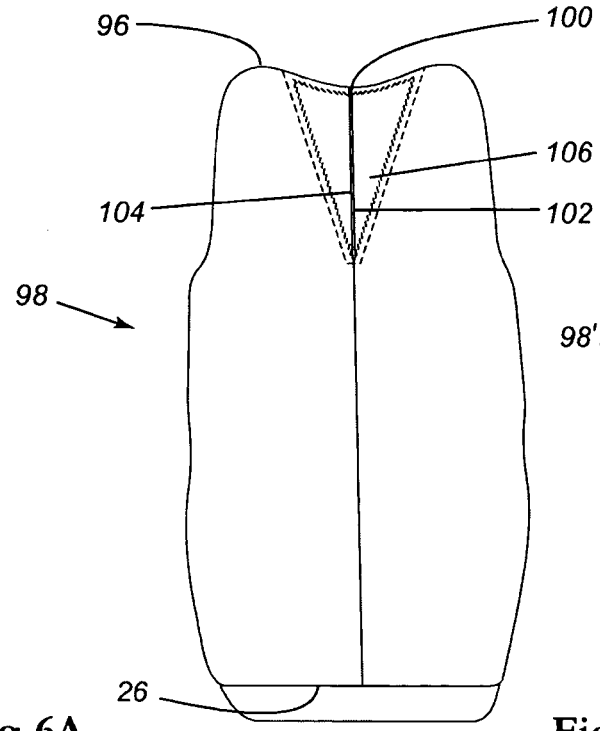
FIG. 6A is a rear elevation view of a skate boot including a slit for facilitating a plantar flexion
Figure 6B:
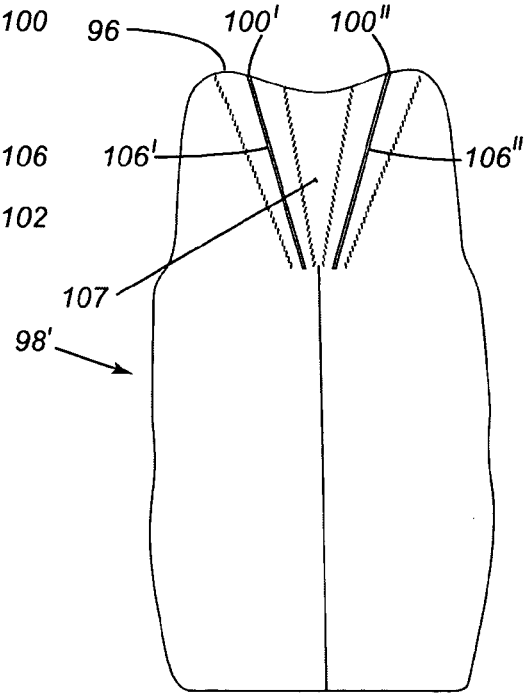
FIG. 6B is a rear elevation view of an alternative skate boot including a slit for facilitating a plantar flexion.
Figure 6C:
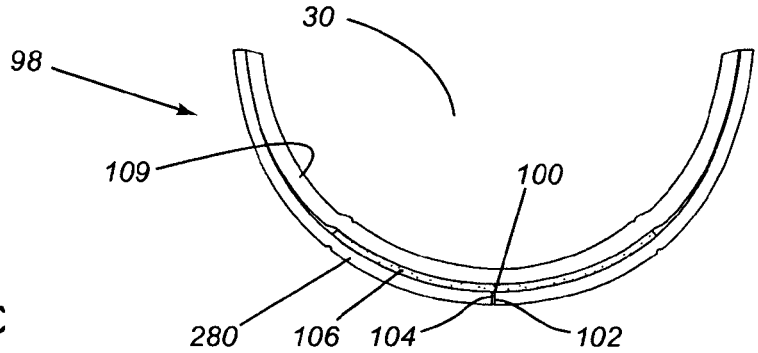
FIG. 6C is a cross-section of the skate boot of FIG. 6A.

FIGS. 6A, 6B and 6C illustrate another feature provided in some embodiments of the invention. As shown in FIG. 6A, in a boot 98, the opening 30 defines an opening peripheral edge including a rear edge portion 96 provided within a rear upper section 28D. The rear upper section 28D does not include a deformable region similar to the deformable region 70. However, it is within the scope of the invention to have the feature illustrated in FIGS. 6A, 6B and 6C provided in conjunction with deformable regions similar to deformable region 70.

The boot 98 illustrated in FIG. 6A includes a slit 100 extending within the rear upper section 28D substantially from the rear edge portion 96 and substantially towards the plantar upper section 26. The slit defines two substantially opposed edges 102 and 104.

In addition, as better shown in FIG. 6C, the boot 98 includes an elastic piece of material 106 connected to the opposed edges 102 and 104 and extending therebetween. In some embodiments of the invention, the elastic piece of material 106 includes a wedge pointing substantially towards the plantar upper section 26.

As shown in FIG. 6A, the elastic piece of material 106, which can be any suitable elastically deformable material that is more deformable than adjacent portions of the boot 98, is detached from the rear upper section 28D along at least part of the rear edge portion 96. This allows the two edges 102 and 104 to move substantially away from each other when the foot performs a plantar flexion. Since the elastic piece of material extends between the edges 102 and 104, the elastic piece of material 106 prevents foreign objects from intruding within the boot 98 when the edges 102 and 104 are moved away from each other.

Typically, but not necessarily, the boot 98 includes an elastic upper liner 109 that sandwiches the elastic piece of material 106 in conjunction with the rear upper section 28D. The elastic upper liner 109 is any suitable liner, such as, for example, a Lycra™ liner, such liners being well known in the art.

As shown in FIG. 6A, the elastic piece of material 106, which can be any suitable elastically deformable material that is more deformable than adjacent portions of the boot 98, is detached from the rear upper section 28D along at least part of the rear edge portion 96. This allows the two edges 102 and 104 to move substantially away from each other when the foot performs a plantar flexion. Since the elastic piece of material extends between the edges 102 and 104, the elastic piece of material 106 prevents foreign objects from intruding within the boot 98 when the edges 102 and 104 are moved away from each other.

FIG. 6B illustrates an alternative boot 98 illustrated in including two slits 100' and 100" extending within the rear upper section 28E substantially from the rear edge portion 96 and substantially towards the plantar upper section 26. Each slit defines two substantially opposed edges. A guard 107 extends between the slits 106' and 106". In FIG. 6B, slits 100' and 100" are slightly angled with respect to each other. However, in other embodiments of the invention, the two slits are substantially parallel.

Also, the boot 98' includes two elastic pieces of material 106' and 106" extending respectively across slits 100' and 100". In alternative embodiments of the invention, a single elastic piece of material extends across both slits 100' and 100".

The slits 100' and 100", along with the pieces of material 106' and 106" perform a function similar to the slit 100 and the piece of material 106 in that they facilitate a plantar flexion of the foot of the user while protecting the achilles tendon. However, in opposition to the boot 98, the boot 98' includes a guard 107 including a substantially rigid material to provides a better protection to this tendon in some embodiments of the invention.

Figure 5A:
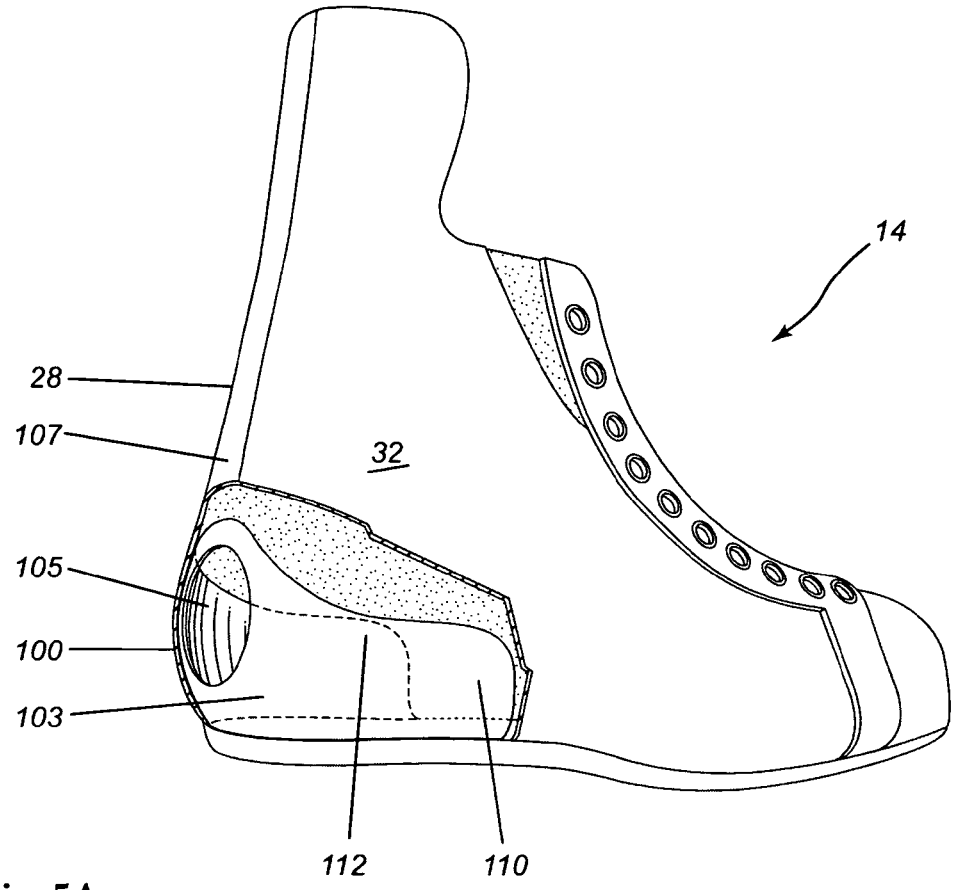
FIG. 5A is a perspective view illustrating a skate boot including a heel counter having a hollow.
Figure 5B:
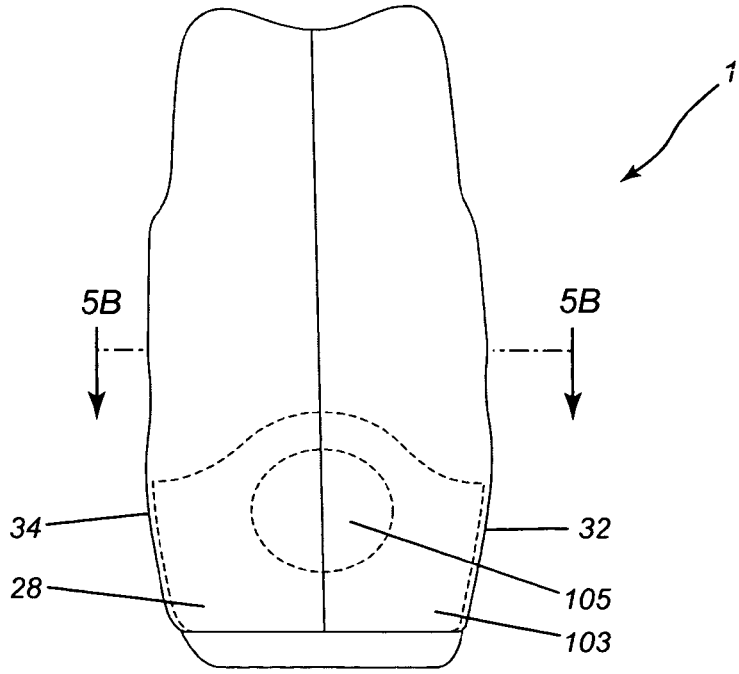
FIG. 5B is a rear elevation view of the skate boot of FIG. 5A.
Figure 5C:
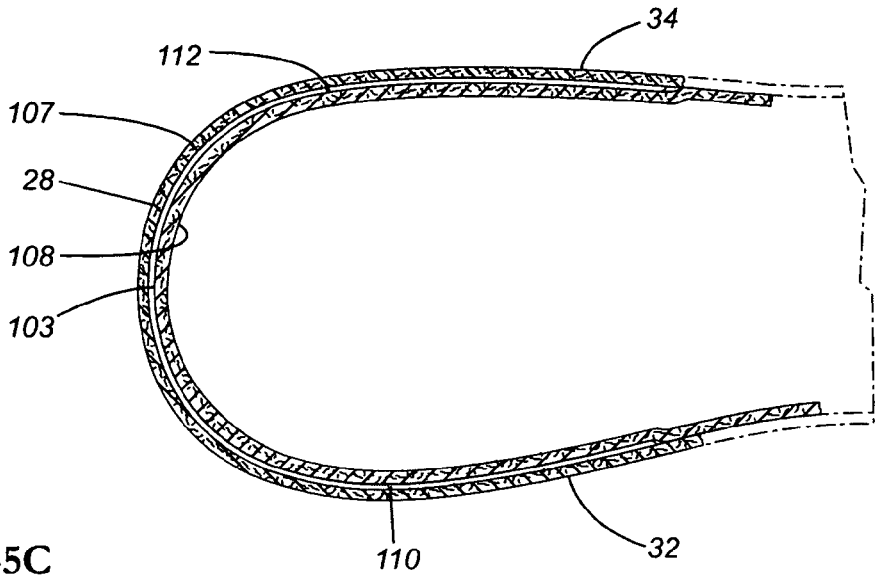
FIG. 5C is a cross-section view of the skate boot of FIG. 5A.

FIGS. 5A, 5B and 5C illustrate yet another feature included in some embodiments of the invention. As shown in FIG. 5A, the boot 14 includes a heel upper section 100 for receiving the heel of the foot. The heel upper section 100 includes a heel counter 103 defining a hollow 105 for relieving the pressure exerted by the upper onto the heel upon a dorsiflexion of the foot.

More specifically, the upper includes an outer shell 107 provided at least in part within the rear upper section 28 and the lateral upper sections 32 and 34. In addition, as better shown on FIG. 5C, which is a cross section of the boot 14 taken across the line 5B-5B, the boot 14 includes a liner 108 provided within the outer shell 107. The heel counter 103 is provided between the outer shell 107 and the liner 108.

The liner 108 includes a deformable padding provided in proximity to the hollow 105. The deformable padding and the hollow 105 cooperate to distribute a force exerted by the upper onto the heel over an area that is larger than an area over which the force exerted by the upper onto the heel is distributed when the hollow 105 is absent from the upper. Therefore, the pressure exerted onto the heel is reduced.

In some embodiments of the invention, the hollow 105 is located, configured and sized to receive a portion of the heel in proximity to the heel bone. In specific embodiments of the invention, the hollow 105 is dimensioned to receive substantially only the heel bone. In alterantive specific embodiments of the invention, the hollow 105 is dimensioned to receive the heel bone and part of surrounding tissues of the foot.

In some embodiments of the invention, the heel counter 103 also includes a material that is substantially more rigid than the deformable padding.

The exact shape of the hollow 105 depends on the specific embodiment of the invention. For example, in some embodiments of the invention the hollow 105 is substantially circular. In other embodiments of the invention, the hollow 105 is substantially elliptical and oriented such that the hollow 105 is wider in a direction substantially perpendicular to the plantar upper section 26 than in a direction substantially parallel to the plantar upper section 26.

As shown in FIG. 5A, in some embodiments of the invention, the heel counter 103 includes two lateral flaps 110 and 112 extending away from the rear upper section 28 within the outer shell 106. The lateral flaps 110 and 112 are configured and sized to receive the ankle such as to interfere with the rotation of the ankle in a plane substantially parallel to the plantar foot surface. In addition, the lateral flaps 110, 112 are configured and sized such as to allow a rotation of the ankle in a plane substantially perpendicular to the plantar foot surface. However, in other embodiments of the invention the lateral flaps 110 and 112 are absent from the heel counter.

In some embodiments of the invention, the shape of the heel counter 103 is such that the heel counter 103 extends further away from the plantar upper section 26 in proximity to the hollow 105 than within the lateral flaps 110 and 112.

Figure 4A:
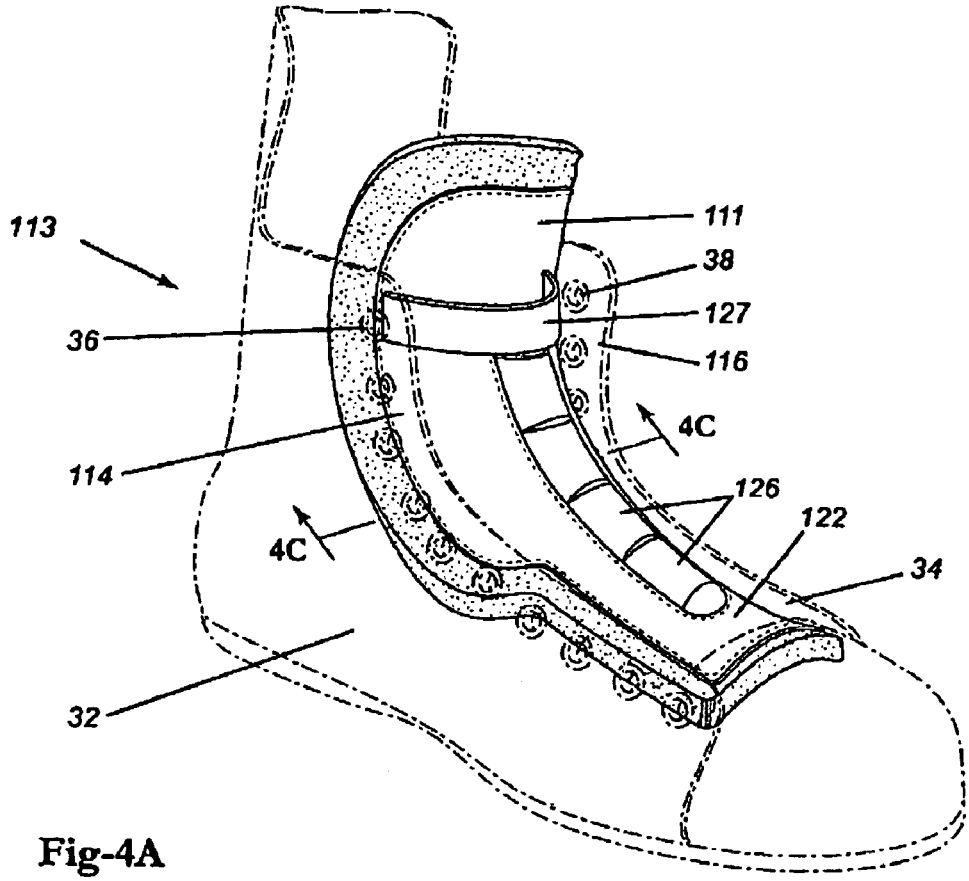
FIG. 4A is a perspective view of a skate boot including an ergonomic tongue.
Figure 4B:
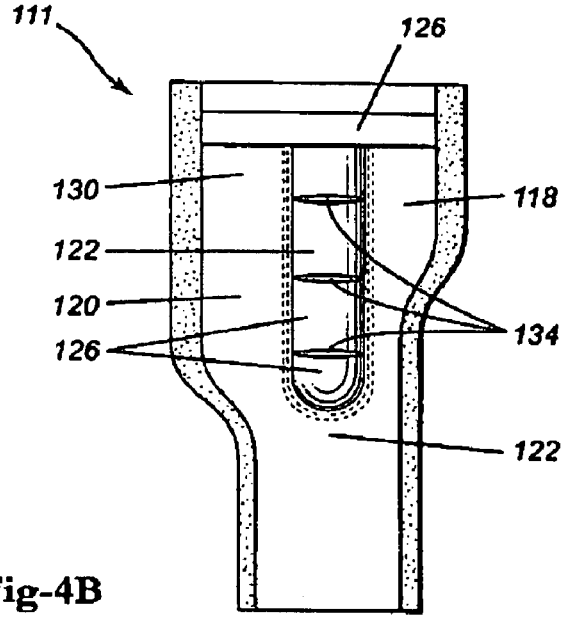
FIG. 4B is a top elevation view of the tongue of FIG. 4A.
Figure 4C:
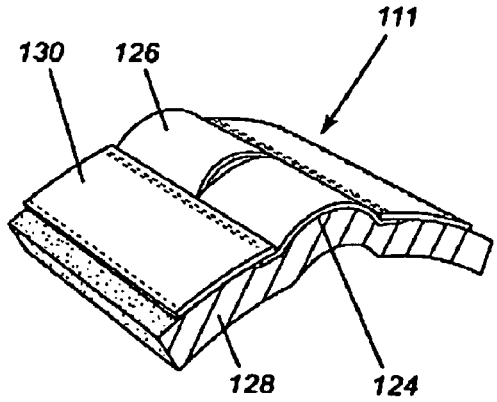
FIG. 4C is a cross-section view of the tongue of FIG. 4A.

FIGS. 4A, 4B and 4C illustrate yet another feature included in some embodiments of the invention. These Figures show a tongue 111 provided within a generic skate boot 113. In some embodiments of the invention, the skate boot 112 includes any of the above-described features alone or in combination.

As shown in the drawings, the boot 113 includes two strips of eyelets 114 and 116 provided peripherally to the lateral upper sections 32 and 34. A lace, not shown in the drawings, links the first and the second strips of eyelet so as to secure the foot within the boot 113.

As better seen in FIG. 4B, the tongue 111 defines a tongue longitudinal axis, the tongue 111 being asymmetrical with respect to the tongue longitudinal axis. The tongue 111 includes two lateral tongue portions 118 and 120 and the central tongue portion 122 extending therebetween. The two lateral tongue portions 118 and 120 each extend only along part of the central tongue portion 122. The lateral tongue portion 118 extends outwardly from the central tongue portion substantially towards the sagittal plane of the user when the skate boot is worn by the user. Therefore, the lateral tongue portion 120 extends outwardly from the central tongue portion 122 substantially away from the sagittal plane when the boot is worn by the user.

For example, for a right skate boot, the lateral tongue portion 118 extends outwardly from the central tongue portion substantially towards the left foot.

The lateral tongue portion 120 extends more along the central tongue portion 122 than the lateral tongue portion 118. In specific embodiments of the invention, the lateral tongue portions 118 and 120 each extend toward the ankle of the foot so as to be in proximity to the ankle bone when the user wears the skate boot. Therefore, the asymmetry of the tongue 111 reflects the asymmetry of the ankle of the user.

As shown in FIG. 4C, the central tongue portion 122 includes a recess 124 for reducing pressure exerted by the tongue 111 on the extensor halucis longus tendon upon a dorsiflexion of the foot. The recess includes a substantially rigid material 126 for contacting the lace when the lace is laced through the eyelets. The substantially rigid material is substantially more rigid than a material present in other parts of the tongue 111.

In addition, still to improve the comfort of the user, the tongue 111 includes a tongue lining 128 proximal to the foot and the tongue shell 130 distal from the foot, the tongue lining 128 being substantially more deformable than the tongue shell 130. Among other materials, the tongue shell includes the rigid material 126 of the recess.

To improve the flexibility of the tongue 111 upon a dorsiflexion or plantar flexion of the foot, at least one opening, and in the specific example shown in the drawings, a plurality of openings 134 are provided within the rigid material 126 of the recess 124. In a specific example of the embodiment of the invention, the openings 134 are almond shaped.

Since the lace is typically double or triple laced in proximity to the eyelets 36 and 38, in some embodiments of the invention a lacing track 127 is connected to the outer tongue shell 130 and provided in proximity to the eyelets 36 and 38 most distal from the plantar upper surface 26. The lacing track 127 rigidifies the tongue 111 so as to reduce pressure exerted by the lace onto the foot located within the boot.

The outer tongue shell 130 includes any suitable material such as, for example, leather, or a synthetic molded material, among others.

When present in a skate boot, the above-described features improve the comfort and ergonomics of the boot upon a dorsiflexion or plantar flexion of the foot as follows.

First, the deformable regions allowing the eyelets 36 and 38 to be mobile with respect to other parts of the boot allow the boot to conform more to a dorsiflexion of the foot. Therefore, the pressure exerted by the boot onto the foot upon dorsiflexion is reduced. Indeed, the deformable regions are substantially less rigid than adjacent portions of the boot. Therefore, the deformable regions deform more in response to a movement of the foot within the boot than the adjacent portions of the boot. In addition, the deformable regions provides a biasing force opposing dorsiflexion, which stabilizes the foot within the boot.

The tongue 111, or any other suitable tongue, reduces the problem commonly known as "lace bite", wherein laces exert strong pressure onto the tendons of the foot upon dorsiflexion of the foot. In addition, the asymmetric shape of the tongue conforms more closely to the anatomy of the foot, and therefore helps to distribute suitably the forces exerted by the tongue onto the foot.

The heel counter 103 reduces substantially the pressure exerted by the boot onto the heel of the user. This greatly increases the comfort provided by the boot and also greatly reduces the risk of injuries to the heel.

In addition, the shape of the lateral flaps 102 and 104 supports the ankle such that undesirable rotations are prevented and desired rotations are allowed.

Finally, the slit 100 provided on the rear upper section of the boot facilitates a plantar flexion movement of the foot when the skate is worn. This is caused by an extension of the rear section which allows the back portion of the leg of the user to move more easily within the boot.

Although only some features of skates that are within the scope of the appended claims are described hereinabove, the above-describe skates and other skates that are within the scope of the claims include any other suitable, such as, for example, any feature commonly found in skates. These features are well known in the art and are therefore not described herein. Non-limiting examples of such features include soles and insoles, among others.

Although the present invention has been described hereinabove by way of preferred embodiments thereof, it can be modified, without departing from the spirit and nature of the subject invention as defined in the appended claims.

What is claimed is:

1. A skate boot for receiving the foot, the ankle and adjacent leg section of an intended user, the anide having a malleolus, said foot defining a dorsal foot section and a substantially opposed plantar foot section, said skate boot comprising:

a. an upper, said upper defining:

i. a dorsal upper section and a substantially opposed plantar upper section;

ii. a rear upper section extending outwardly from and substantially peripherally to said plantar upper section;

iii. a vamp for maintaining said foot between said dorsal and plantar upper sections, said vamp being located substantially longitudinally opposed to said rear upper section;

iv. two substantially laterally opposed quarters each extending between said rear upper section and said vamp, each of said quarter defining a respective nose located substantially adjacent said vamp, said dorsal upper section defining an inflection point substantially adjacent said nose, each of said quarter also defining a respective malleolus receiving section for receiving the malleolus of the ankle of the intended user; and v. an opening allowing the user to insert the foot within said skate boot, said opening extending between said rear upper section and said dorsal upper section;

b. said upper including a deformable region extending generally perpendicularly to said plantar upper section and located substantially further away from said plantar upper section than said malleolus receiving section, said deformable region being provided for facilitating the elastic dorsiflexion of said upper between an initial upper configuration and a dorsiflexed upper configuration wherein said vamp is closet to said rear upper section than in said initial upper configuration, said deformable region being substantially more elastically deformable than adjacent upper portions of said upper and providing an elastic force biasing said upper towards said initial configuration upon dorsiflexion of said upper.

2. A skate boot as defined in claim 1, wherein said upper further defines first and second lateral upper sections, said first and second lateral upper section each extending outwardly from and substantially peripherally to said plantar upper section, said rear upper section connecting said first and second lateral upper sections.

3. A skate boot as defined in claim 2, wherein said deformable region reduces a buckling of said first and second lateral upper sections upon a dorsiflexion of said upper wherein said upper passes from said upper initial upper configuration to said dorsiflexed upper configuration.

4. A skate boot as defined in claim 3, further comprising a fastening device for connecting said first and second lateral upper sections.

5. A skate boot as defined in claim 4, wherein said fastening device includes a mobile fastening portion.

6. A skate boot as defined in claim 5, wherein said deformable region allows said mobile fastening portion to be further from at least part of said rear upper section when said upper is in said dorsiflexed upper configuration than when said upper is in said initial upper configuration, when said dorsiflexed upper configuration is achieved through a dorsiflexion of the foot.

7. A skate boot as defined in claim 6, wherein said deformable region includes a panel blocking a cut-out region of said upper.

8. A skate boot as defined in claim 7, wherein said panel includes rubber.

9. A skate boot as defined in claim 7, wherein said panel is glued to adjacent portions, said adjacent portions being adjacent to said cut-out region.

10. A skate boot as defined in claim 7, wherein said panel is stitched to adjacent portions, said adjacent portions being adjacent to said cut-out region.

11. A skate boot as defined in claim 7, wherein said upper includes an external shell defining interior and an exterior shell surfaces, said insert being attached to said interior shell surface.

12. A skate boot as defined in claim 6, wherein the foot includes a heel, said upper comprising a heel upper section for receiving the heel, said heel upper section including a heel counter defining a hollow for relieving a pressure exerted by said upper onto the heel upon a dorsiflexion of the foot.

13. A skate boot as defined in claim 12, wherein:

a. said upper includes an outer shell provided at least in part within said rear upper section and said first and second lateral upper sections;

b. said upper further includes a liner provided within said outer shell; and c. said heel counter is provided between said outer shell and said liner.

14. A skate boot as defined in claim 13, wherein said liner includes a deformable padding provided in proximity to said hollow.

15. A skate boot as defined in claim 14, wherein said deformable padding and said hollow cooperate to distribute a force exerted by said upper onto the heel over an area that is larger than an area over which the force exerted by said upper onto the heel is distributed when the hollow is absent from said upper, thereby reducing the pressure exerted onto the heel.

16. A skate boot as defined in claim 15, wherein the heel includes a heel bone and wherein said hollow is located, configured and sized to receive the heel bone.

17. A skate boot as defined in claim 16, wherein said heel counter includes a material that is substantially more rigid than said deformable padding.

18. A skate boot as defined in claim 17, wherein said hollow is substantially circular.

19. A skate boot as defined in claim 17, wherein said hollow is substantially elliptical and defines a minor axis and a major axis, said minor axis being oriented substantially perpendicularly to said plantar upper section.

20. A skate boot as defined in claim 19, wherein said heel counter further includes first and second lateral flaps extending away from said rear upper section and within said outer shell.

21. A skate boot as defined in claim 20, wherein said first and second lateral flaps are configured and sized to receive the ankle such as to interfere with a rotation of the anide relatively to said skate boot in a plane substantially parallel to the plantar foot surface.

22. A skate boot as defined in claim 20, wherein said first and second lateral flaps are configured and sized such as to allow a rotation of said ankle relatively to said skate boot in a plane extending substantially longitudinally respectively to said skate boot and substantially perpendicular to said planter foot surface.

23. A skate boot as defined in claim 22, wherein said heel counter extends further away from said plantar upper section in proximity to said hollow than within said first and second lateral flaps.

24. A skate boot as defined in claim 6, wherein:

a. said first and second lateral upper sections each include respectively a first and a second strip of eyelets strip, each of said first and second strips of eyelet including a plurality of eyelets located peripherally to said first and second lateral upper sections; and b. said plantar upper section includes a tongue.

25. A skate boot as defined in claim 24, wherein said tongue defines a tongue longitudinal axis and wherein said tongue is asymmetrical with respect to said tongue longitudinal axis.

26. A skate boot as defined in claim 25, wherein said tongue includes a. first and second lateral tongue portions; and b. a central tongue portion extending therebetween;

c. said first and second lateral tongue portions each extending only along part of said central tongue portion.

27. A skate boot as defined in claim 26, wherein the user defines a sagittal plane and said first lateral tongue portion extends outwardly from said central tongue portion substantially towards the sagittal plane when said skate boot is worn by the user.

28. A skate boot as defined in claim 27, wherein said second lateral tongue portion extends outwardly from said central tongue portion substantially away from the sagittal plane when said skate boot is worn by the user.

29. A skate boot as defined in claim 28, wherein said second lateral tongue portion extends more along said central tongue portion than said first lateral tongue portion.

30. A skate boot as defined in claim 29, wherein the ankle includes an ankle bone, the first and second lateral tongue portion each extending towards the ankle for being in proximity to the ankle bone when the user wears said skate boot.

31. A skate boot as defined in claim 25, wherein the foot includes an extensor hallucis longus tendon, said central tongue portion including a recess for reducing a pressure exerted be said tongue on the extensor hallucis longus tendon upon a dorsiflexion of the foot.

32. A skate boot as defined in claim 31, wherein said recess includes a substantially rigid material for contacting said lace when said lace is laced through said eyelets.

33. A skate boot as defined in claim 31, wherein said tongue includes a tongue lining proximal to the foot and a tongue shell distal from the foot, said tongue lining being substantially more deformable than said tongue shell.

34. A skate boot as defined in claim 33, wherein said tongue shell includes said rigid material of said recess.

35. A skate boot as defined in claim 34, wherein said rigid material of said recess includes a plurality of openings for improving a flexibility of said tongue such that the dorsiflexion of said skate boot is facilitated.

36. A skate boot as defined in claim 35, wherein said openings are substantially almond-shaped.

37. A skate boot as defined in claim 35, wherein said tongue includes a lacing track connected to said outer tongue shell and provided in proximity to eyelets most distal from said plantar upper surface, said lacing track rigidifying said tongue such as to reduce a pressure exerted onto the leg by said fastening device.

38. A skate boot as defined in claim 35, wherein said outer tongue shell includes a material selected from the group including leather and a synthetic molded material.

39. A skate boot as defined in claim 38, wherein said rigid material of said recess includes a polymer.

40. A skate boot as defined in claim 1, wherein:

a. said deformable region is a first deformable region; and b. said upper includes a second deformable region for facilitating the elastic dorsiflexion of said upper between the initial upper configuration and the dorsiflexed upper configuration, said second deformable region being substantially more elastically deformable than adjacent upper portions of said upper end providing an elastic force biasing said upper towards said initial configuration upon dorsiflexion of said upper.

41. A skate boot as defined in claim 40, wherein said second deformable region is provided at least in part within said rear upper section.

42. A skate boot as defined in claim 2, wherein a. said fastening device includes a first snip of eyelets and a second strip of eyelets, said first and second snip of eyelets each including respectively a first and a second eyelet, said first and second scrip of eyelets being provided within said first and second lateral upper sections; and b. said lace is for connecting said first and second strips of eyelets.

43. A skate boot as defined in claim 42, wherein said skate boot includes a material selected from the group including leather, synthetic leather and polymers.

44. A skate for receiving the foot the ankle and adjacent leg section of an intended user, said foot defining a dorsal foot section and a substantially opposed plantar foot section, said skate comprising a skate boot for receiving the foot, the ankle and adjacent leg section of the user, said skate boot including a. an upper, said upper defining:

i. a dorsal upper section and a substantially opposed plantar upper section;

ii. a rear upper section extending outwardly from and substantially peripherally to said plantar upper section;

iii. a vamp for maintaining said foot between said dorsal and plantar upper sections, said vamp being located substantially longitudinally opposed to said rear upper section;

iv. two substantially laterally opposed quarters each extending between said rear upper section and said vamp, each of said quarter defining a respective nose located substantially adjacent said vamp, said dorsal upper section defining an inflection point substantially adjacent said nose, each of said quarter also defining a respective malleolus receiving section for receiving the malleolus of the ankle of the intended user; and v. opening allowing the user to insert the foot within said skate boot, said opening extending between said rear upper section and said dorsal upper section;

b. said upper including a deformable region extending generally perpendicularly to said plantar upper section and located substantially further away from said plantar upper section than said malleolus receiving section, said deformable region being provided for facilitating the elastic dorsiflexion of said upper between an initial upper configuration and a dorsiflexed upper configuration wherein said vamp is closer to said rear upper section than in said initial upper configuration, said deformable region being substantially more elastically deformable than adjacent upper portions of said upper and providing an elastic force biasing said upper towards said initial configuration upon dorsiflexion of said upper.

45. A skate as defined in claim 44, wherein said skate is an ice skate comprising a blade assembly fixedly connected to said upper.

46. A skate as defined in claim 44, wherein said skate is a roller skate comprising a roller assembly fixedly connected to said upper.

* * * * *